US010414535B2

(12) United States Patent
Barbieri et al.

(10) Patent No.: US 10,414,535 B2
(45) Date of Patent: Sep. 17, 2019

(54) SHEET PACKAGING MATERIAL FOR PRODUCING SEALED PACKAGES FOR POURABLE FOOD PRODUCTS

(71) Applicant: TETRA LAVAL HOLDINGS & FINANCE S.A., Pully (CH)

(72) Inventors: Marcello Barbieri, Modena (IT); Siegrid Putzer, Nova Levante-Bolzano (IT); Massimiliano Cereda, Modena (IT); Marco Poppi, Modena (IT); Roberto De Pietri Tonelli, Colombaro di Formigine (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 62 days.

(21) Appl. No.: 15/521,820

(22) PCT Filed: Oct. 27, 2015

(86) PCT No.: PCT/EP2015/074830

§ 371 (c)(1),
(2) Date: Apr. 25, 2017

(87) PCT Pub. No.: WO2016/066624

PCT Pub. Date: May 6, 2016

(65) Prior Publication Data

US 2017/0253365 A1 Sep. 7, 2017

(30) Foreign Application Priority Data

Oct. 29, 2014 (EP) ..... 14190892

(51) Int. Cl.
*B65D 5/06* (2006.01)
*B65D 85/72* (2006.01)
*B65D 5/42* (2006.01)

(52) U.S. Cl.
CPC ..... *B65D 5/064* (2013.01); *B65D 5/067* (2013.01); *B65D 5/4266* (2013.01); *B65D 85/72* (2013.01)

(58) Field of Classification Search
CPC ..... B65D 5/064; B65D 5/067; B65D 5/4266; B65D 85/72; B65D 5/746; B65D 5/46;
(Continued)

(56) References Cited

U.S. PATENT DOCUMENTS 4,691,858 A 9/1987 Peer, Jr.
6,253,994 B1 * 7/2001 Mogard ..... B29C 66/004 229/125.04

(Continued)

FOREIGN PATENT DOCUMENTS

CN 1446167 A 10/2003
CN 1479685 A 3/2004

(Continued)

OTHER PUBLICATIONS

International Search Report (PCT/ISA/210) dated Dec. 14, 2015, by the European Patent Office as the International Searching Authority for International Application No. PCT/EP2015/074830.

(Continued)

*Primary Examiner* — Christopher D Demeree
(74) *Attorney, Agent, or Firm* — Buchanan Ingersoll & Rooney PC

(57) ABSTRACT

A sheet packaging material for producing a package comprises at least one first crease line and at least one second crease line, at least one third crease line which intersects said first crease line in at least one first point and said second crease line in at least one second point, at least one fourth crease line, at least one fifth crease line, which extends between said first point and said fourth crease line, at least one sixth crease line, which extends between said second point and said fourth crease line, said first point and said fourth crease line being spaced by a first distance, said second point and said fourth crease line being spaced by a second distance, said first crease line and said second crease line being spaced by a third distance, wherein the sum of said first distance and said second distance is less than said third distance.

43 Claims, 9 Drawing Sheets

(58) Field of Classification Search
CPC ..... B65D 5/0209; B65D 5/029; B65D 5/069; B65D 5/40; B65D 5/06; B65B 9/22; B29C 66/112; B29C 66/131; B29C 66/53247; B29C 66/72328; B29L 2031/7166
USPC ..... 229/171, 249, 108, 125.04, 215
See application file for complete search history.

(56) References Cited

U.S. PATENT DOCUMENTS

| | | | | |
|---|---|---|---|---|
| 6,929,171 | B1 * | 8/2005 | Thiersch | B65D 5/029 229/108 |
| 8,292,108 | B2 * | 10/2012 | Rosentreler | B65D 5/746 220/62 |
| 8,528,807 | B2 * | 9/2013 | Kaneko | B65D 5/064 229/125.14 |
| 2003/0146271 | A1 * | 8/2003 | Furini | B65B 9/2049 229/125.15 |
| 2004/0011688 | A1 * | 1/2004 | Ishikawa | B65B 9/20 206/431 |
| 2004/0055918 | A1 | 3/2004 | Benedetti et al. | |

FOREIGN PATENT DOCUMENTS

| | | | |
|---|---|---|---|
| EP | 1 332 969 | A1 | 8/2003 |
| EP | 3000584 | A1 | 9/2014 |
| JP | 52-037033 | U | 3/1977 |
| JP | 60-045140 | A | 3/1985 |
| JP | 61-183811 | U | 11/1986 |
| WO | 02/48001 | A1 | 6/2002 |
| WO | WO 02/48001 | A1 | 6/2002 |
| WO | 2015/028066 | A1 | 3/2015 |

OTHER PUBLICATIONS

Written Opinion (PCT/ISA/237) dated Dec. 14, 2015, by the European Patent Office as the International Searching Authority for International Application No. PCT/EP2015/074830.

Office Action (Notification of the First Office Action) dated Jul. 31, 2018, by the State Intellectual Property Office (SIPO) of the Peoples Republic of China in corresponding Chinese Patent Application No. 201580051387.6 and an English Translation of the Office Action. (11 pages).

Orthotropic Elastic Constants of Paper by G. A. Baum, D.C. Brennan, C. C. Habeger, The Institute of Paper Chemistry, Tappi, Aug. 1981, vol. 64, No. 8.

Office Action and Search Report dated May 14, 2019, by the Russian Patent Office in corresponding Russian atent Application No. 2017118334 and an English translation of the Office Action. (11 pages).

Japanese Office Action dated Jul. 30, 2019 issued in corresponding Japanese Patent Application No. 2017-522129, with English translation (8 pages).

* cited by examiner

SHEET PACKAGING MATERIAL FOR PRODUCING SEALED PACKAGES FOR POURABLE FOOD PRODUCTS

TECHNICAL FIELD

The present invention relates to a sheet packaging material for producing sealed packages for pourable food products.

BACKGROUND OF INVENTION

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by creasing and sealing laminated strip packaging material. The packaging material has a multilayer structure comprising a base layer, e.g. of paper, covered on both sides with layers of heat-seal plastic material, e.g. polyethylene. In the case of aseptic packages for long-storage products, such as UHT milk, the packaging material also comprises a layer of oxygen-barrier material, e.g. an aluminium foil, which is superimposed on a layer of heat-seal plastic material, and is in turn covered with another layer of heat-seal plastic material forming the inner face of the package eventually contacting the food product.

A package is known which comprises:

- a rectangular bottom wall which is crossed by a bottom transversal seal;
- a rectangular top wall, which is crossed by a top transversal seal;
- a rear wall which extends between corresponding first edges of top wall and bottom wall;
- a front wall which is opposite to the rear wall and extends between corresponding second edges, opposite to first edges, of top wall and bottom wall; and
- a pair of lateral walls interposed between bottom wall and top wall, and between rear wall and front wall.

Furthermore, the package comprises a top transversal sealing band and a bottom transversal sealing band, which extend across respective top wall and bottom wall.

The top sealing band extends beyond the top wall into respective flat, substantially triangular flaps which are folded coplanar with and onto upper portions of respective lateral walls as of the top wall.

The bottom sealing band comprises a main portion folded over the bottom wall and a pair of lateral portions, which are folded over the main portion. The main portion is folded onto the bottom wall while the lateral portions form two respective flat, substantially triangular lateral bottom flaps of packaging material folded over the main portion.

Furthermore, the substantially triangular flaps are folded coplanar with and onto respective lateral portions of the bottom sealing band as of the lower portions of respective lateral walls.

In the known packages, flaps are shaped as isosceles triangles with two angles of 45 degrees or of more than 45 degrees.

Packages of this sort are normally produced on fully automatic packaging machines, on which a continuous tube is formed from the web-fed packaging material; the web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating; the web so sterilized is then maintained in a closed, sterile environment, and is folded and sealed longitudinally to form a tube, which is fed vertically. Alternatively, the packaging material may be sterilized according to other techniques, e.g. by using low voltage electron beams.

In order to complete the forming operations, the tube is filled with the sterilized or sterile-processed food product, and is sealed and subsequently cut along equally spaced cross sections.

More precisely, the tube is sealed longitudinally and transversally to its own axis, so as to from pillow packs which will be eventually folded to form finished packages with a longitudinal seal and a top transversal seal and a bottom transversal seal.

Alternatively, the packaging material may be cut into blanks, which are formed into packages on forming spindles, and the packages are then filled with the food product and sealed.

In both the cases, known packages are produced starting from a basic unit of packaging material, which is, in the first case, a portion of a web of packaging material, and, in the second case, a precut blank.

In the first case, the web of packaging material comprises a succession of basic units and is:

- folded into a cylinder to form a vertical tube and longitudinally sealed;
- filled continuously with the food product; and
- sealed transversely and cut into the basic units, which are than folded to form successive packages.

In the second case, the basic unit is folded on the forming spindle, is filled with the food product and is sealed at the top and the bottom to form the package.

In both cases, the basic unit has a crease pattern, i.e. a number of crease lines which define respective folding lines, along which the packaging material is folded to form the finished packages.

The crease lines bound a plurality of panels, which define the walls and the flaps of the finished package, once that the basic unit has been folded.

In detail, the crease lines bound:

- a pair of triangular first panels, which are interposed between, respective second triangular panels; and
- a pair of triangular third panels, which are interposed between respective fourth triangular panels.

First (fourth) panels define respectively the inner wall of top (bottom) flaps of finished packages whereas second (third) panels define respectively the outer walls of top (bottoms) flaps of finished packages.

Each first (third) panel is bounded by:

- a segment of a first crease line, which defines the sides of the top (bottom) wall of the finished package; and
- a pair of second crease lines, which extends between respective opposite ends of the segment and a common end on a third crease line.

The third crease line is parallel to the first crease line.

The second crease lines are sloped relative to the first crease line and third crease line.

The base of first (third) panel is defined by the segment of the first crease line while the height of first (third) panel is defined by the distance between the first crease line and the third crease line.

Still more precisely, the first crease line defines with the second crease lines a pair of angles, which are greater than or equal to 45 degrees. In other words, the height of first (third) panels is greater than or equal to a half of the base of the same first (third) panels.

On one hand, a need is felt within the industry to reduce the amount of packaging material required for manufacturing a sealed package of a given volume, for evident economic reasons.

On the other hand, a need is felt within the industry to increase the volume of the package which can be formed from a given amount of packaging material, i.e. from a basic unit having a defined size.

DISCLOSURE OF INVENTION

It is therefore an object of the present invention to provide a sheet packaging material for producing sealed packages for pourable food products, which meets at least one of the above-identified needs.

According to a first aspect of the present invention, there is provided a sheet packaging material (M, M', M", M'") for producing a sealed package (1) of a pourable food product. The sheet packaging material comprises at least one first crease line (65; 66) and at least one second crease line (68; 69). The sheet packaging material further comprises at least one third crease line (63; 67) which intersects the first crease line (65; 66) in at least one first point (91; 94; 101; 104) and the second crease line (68; 69) in at least one second point (92; 93; 102; 103). The sheet packaging material also comprises at least one fourth crease line (61; 62) transverse to the first crease line (65; 66) and to the second crease line (68; 69). The sheet packaging material further comprises at least one first panel (151) bounded, at least in part, by the first crease line (65; 66), the second crease line (68, 69) and the third crease line (63; 67). The first panel (151) being adapted to define a lateral wall (9) of the finished package (1) once the sheet packaging material (M, M', M", M'") has been folded. The sheet packaging material further comprises at least one fifth crease line (70, 73; 74, 77), which extends between the first point (91, 94; 101, 104) and the fourth crease line (61; 62) and at least one sixth crease line (71, 72; 75, 76), which extends between the second point (92, 93; 102, 103) and the fourth crease line (61; 62). The sheet packaging material also comprises at least one second panel (160, 161; 170, 171) bounded by the fifth crease line (70, 73; 74, 77), the sixth crease line (71, 72; 75, 76) and a portion of the third crease line (63; 67) interposed between the first point (91; 94; 101; 104) and the second point (92, 93; 102, 103). The second panel (160, 161; 170, 171) is adapted to define at least part of a first folded flap (26; 32) of the finished package (1) once the sheet packaging material (M, M', M", M'") has been folded. The first point (91; 94; 101; 104) and the fourth crease line (61; 62) are spaced by a first distance (H1) and the second point (92, 93; 102, 103) and the fourth crease line (61; 62) are spaced by a second distance (H2). The first crease line (65; 66) and the second crease line (68; 69) are spaced by a third distance (B). The sum of the first distance and the second distance is less than the third distance. The sheet packaging material may further be characterized in that the third distance is equal to the sum of the first distance, the second distance, twice the thickness of the packaging material, and a factor that takes into account the elasticity of the packaging material.

According to a second aspect of the present invention, there is provided a sheet packaging material (M, M', M", M'") for producing a sealed package (1) of a pourable food product. The sheet packaging material comprises at least one first crease line (65; 66) and at least one second crease line (68; 69). The sheet packaging material further comprises at least one third crease line (63; 67) which intersects the first crease line (65; 66) in at least one first point (91; 94; 101; 104) and the second crease line (68; 69) in at least one second point (92; 93; 102; 103). The sheet packaging material also comprises at least one fourth crease line (61; 62) transverse to the first crease line (65; 66) and to the second crease line (68; 69). The sheet packaging material further comprises at least one fifth crease line (70, 73; 74, 77), which extends between the first point (91, 94; 101, 104) and the fourth crease line (61; 62), and at lease one sixth crease line (71, 72; 75, 76), which extends between the second point (92, 93; 102, 103) and the fourth crease line (61; 62). The sheet packaging material also comprises at least one panel (160, 161; 170, 171) bounded by the fifth crease line (70, 73; 74, 77), the sixth crease line (71, 72; 75, 76) and a portion of the third crease line (63; 67) interposed between the first point (91; 94; 101; 104) and the second point (92, 93; 102, 103). The panel (160, 161; 170, 171) is adapted to define at least part of a first folded flap (26; 32) of the finished package (1) once the sheet packaging material (M, M', M", M'") has been folded. The first point (91; 94; 101; 104) and the fourth crease line (61; 62) are spaced by a first distance (H1). The second point (92, 93; 102, 103) and the fourth crease line (61; 62) are spaced by a second distance (H2). The first point (91; 94; 101; 104) and the second point (92, 93; 102, 103) are spaced by a further distance. The sum of the first distance (H1) and the second distance (H2) is less than the further distance.

BRIEF DESCRIPTION OF THE DRAWINGS

Four preferred, non-limiting embodiments of the present invention will be described by way of example with reference to the accompanying drawings, in which.

DETAILED DESCRIPTION OF PREFERRED EMBODIMENTS

Figure 5:
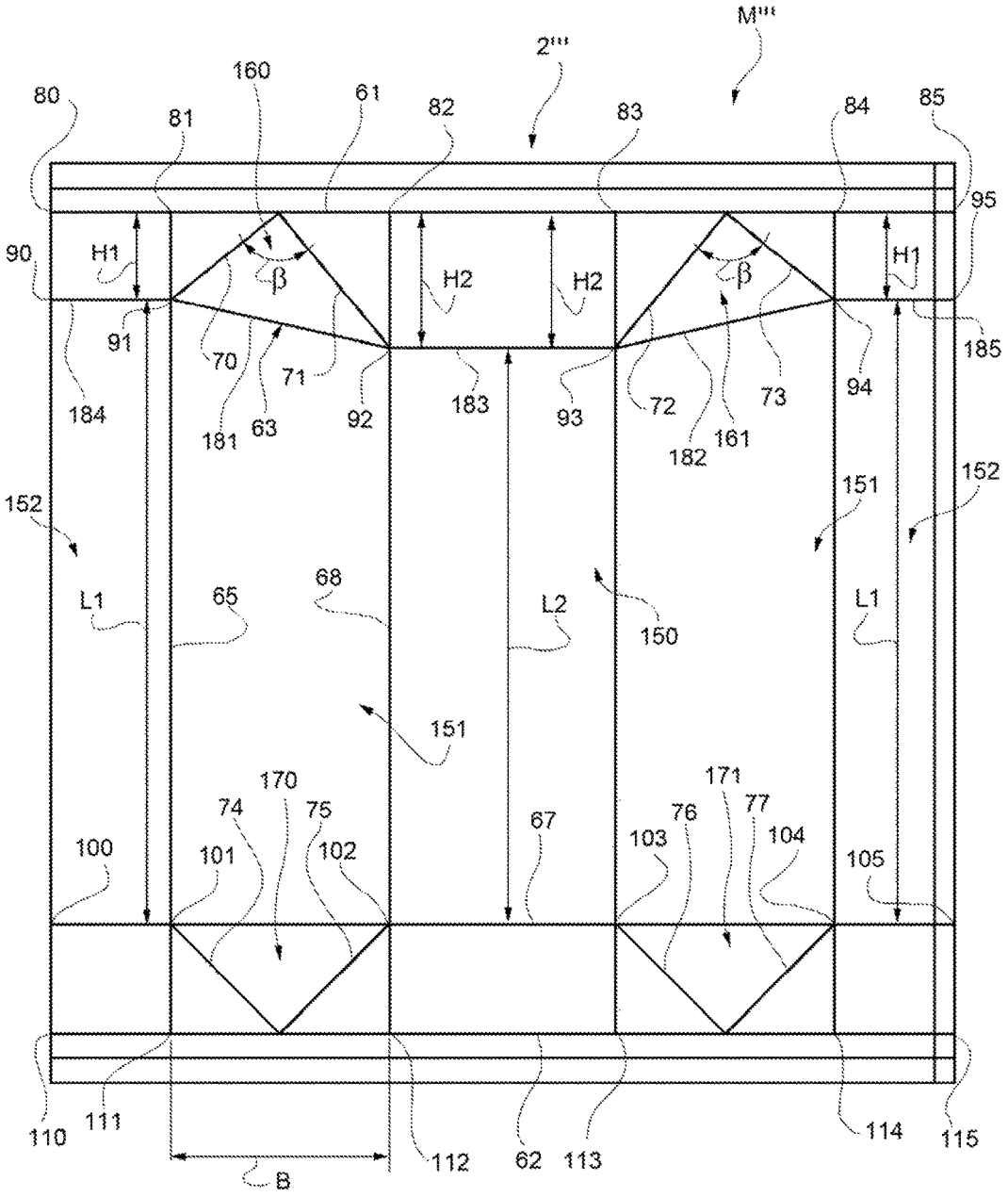
FIG. 5 shows a fourth embodiment of the sheet packaging material according to the present invention.
Figure 6:
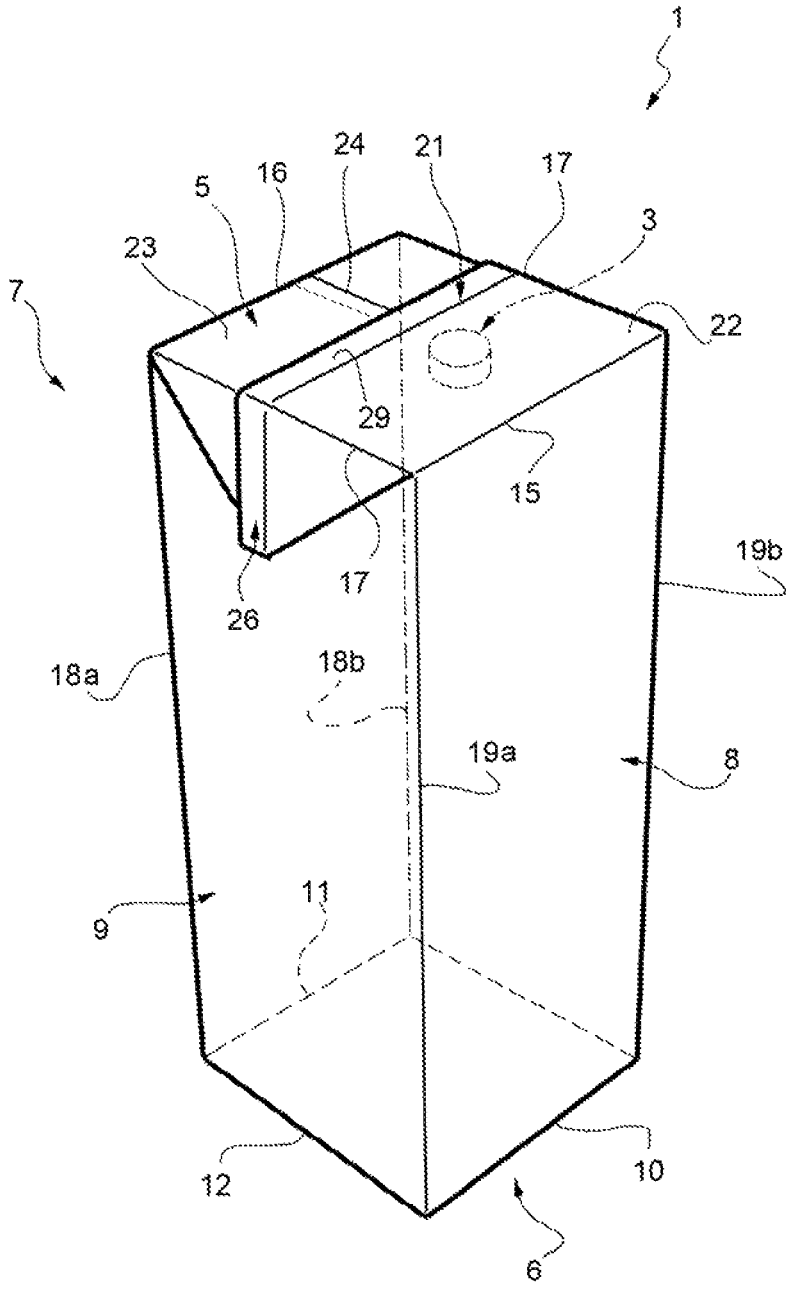
FIGS. 6 and 7 show a top perspective view and a bottom perspective view of a sealed package obtained by the first embodiment of the present invention.
Figure 7:
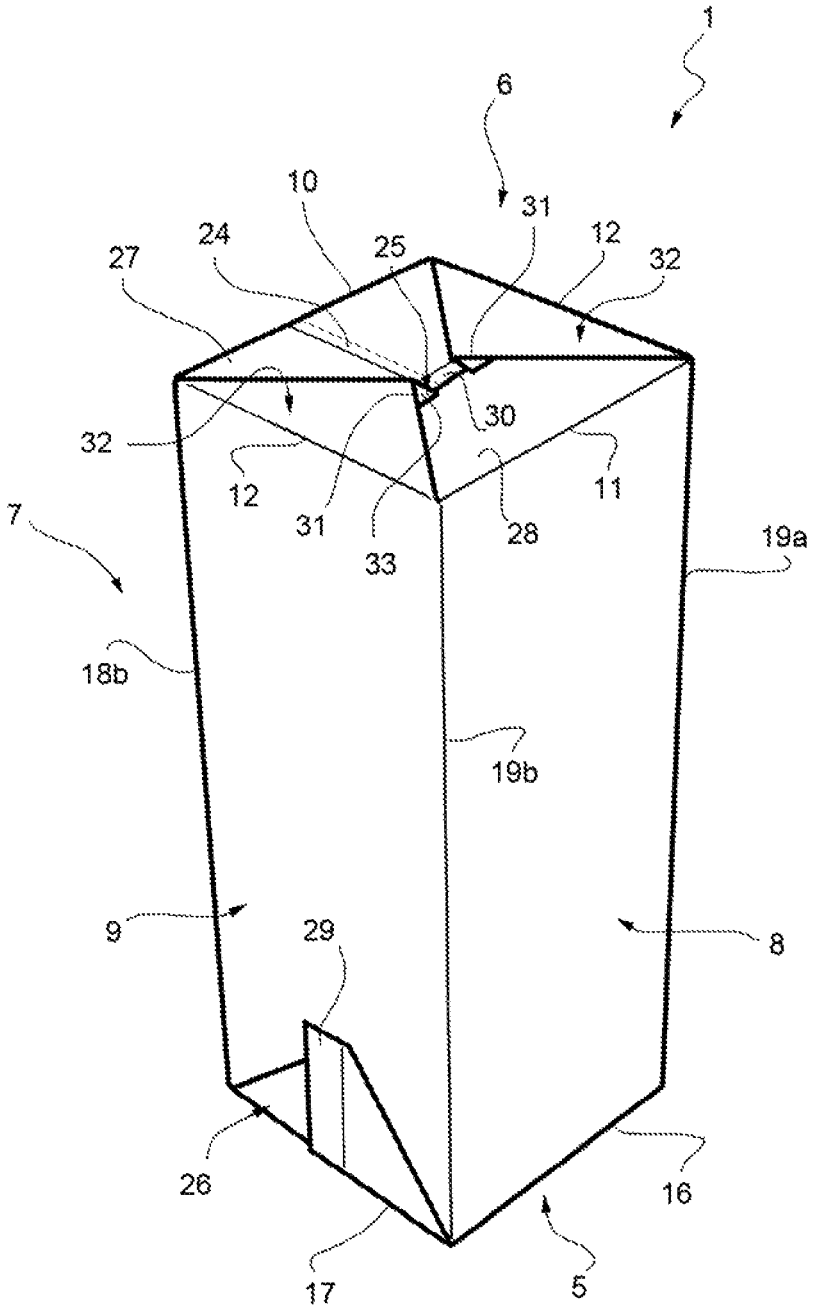

Number 1 in FIGS. 6 and 7 indicates as a whole a sealed package for pourable food products, which is made of multilayer sheet packaging material 2, 2', 2", 2'" (FIGS. 1 to 5) and may be fitted with a reclosable opening device 3 preferably made of a plastic material.

Opening device 3 is applied to package 1 by conventional fastening systems, such as adhesives, or by microflame, electric-current-induction, ultrasound, laser, or other heat-sealing techniques.

Package 1 has preferably a volume of 250 ml or of 500 ml.

Alternatively, package 1 according to the invention can have a different volume.

With reference to FIGS. 6 and 7, package 1 comprises:

- a quadrilateral (in the example shown, rectangular or square) top wall 5;
- a quadrilateral (in the example shown, rectangular or square) bottom wall 6, which is opposite to top wall 5;
- a rear wall 7, which extends between top wall 5 and bottom wall 6;
- a front wall 8, which extends between top wall 5 and bottom wall 6, and is opposite to rear wall 7; and
- two lateral walls 9 opposite to each other, and which extend between top wall 5 and bottom wall 6, and between rear wall 7 and front wall 8.

Bottom wall 6 comprises two horizontal edges 10, 11 parallel to one another, and two horizontal edges 12 interposed between and orthogonal to edges 10, 11. Edges 12 are parallel to one another.

Top wall 5 comprises two horizontal edges 15, 16 opposite to each other and parallel to one another. More precisely, edges 15, 16 are parallel to and arranged over edges 10, 11 respectively.

Top wall 5 also comprises two edges 17, which extend between edges 15, 16 and are parallel to one another.

Edges 17 are arranged over respective edges 12.

Rear wall 7 extends between edges 11, 16 and comprises two vertical opposite edges 18*a*, 18*b* which are parallel to one another and extend between edges 11, 16.

Front wall 8 extends between edges 10, 15 and comprises two vertical opposite edges 19*a*, 19*b*, which extend between edges 10, 15.

Each lateral wall 9 is bounded by edges 12, 17, by a relative vertical edge 18*a*, 18*b*, and by a relative vertical edge 19*a*, 19*b*.

Package 1 also comprises a top transversal sealing band 21 and a bottom transversal sealing band 25, which extends across top wall 5 and bottom wall 6 respectively.

Top transversal sealing band 21 divides top wall 5 into two portions 22, 23, one (22) of which, adjacent to front wall 8 and bounded by edge 15, defines an area for the potential application of opening device 3, while the other portion (23), adjacent to rear panel 7 and bounded by edge 16, comprises along the centerline, an end portion of a flat longitudinal sealing band 24 of package 1 (FIG. 6).

More specifically, longitudinal sealing band 24 extends perpendicularly between top transversal sealing band 21 and bottom transversal sealing band 25, and substantially along the centerline of rear wall 7.

Top transversal sealing band 21 extends beyond top wall 5 of package 1 into respective flat, substantially triangular lateral top flaps 26 (only one of which is shown in FIGS. 6 and 7) of packaging material folded coplanar with and onto respective lateral walls 9 as of top wall 5.

With reference to FIG. 6, top transversal sealing band 21 also forms, lengthwise, a rectangular flat top tab 29 projecting from portions 22, 23 and from lateral top flaps 26 and folded onto portion 23 along a bend line formed at the base of top tab 29.

Bottom transversal sealing band 25 divides bottom wall 6 into two portions 27, 28, one of which (27) is adjacent to rear wall 7, is bound by edge 10 and comprises along the centerline an end portion of longitudinal sealing band 24.

Bottom transversal sealing band 25 comprises a main portion 30 and a pair of end portions 31, which are arranged on opposite lateral sides of main portion 30.

Main portion 30 is folded onto bottom wall 6 while end portions 31 form two respective flat, substantially triangular lateral bottom flaps 32 of packaging material folded over main portion 30.

Bottom transversal sealing band 25 also forms, lengthwise, a flat rectangular bottom tab 33 projecting from portions 27, 28 and which extends into bottom flaps 32. Bottom tab 33 comprises, in turn, a main portion folded over bottom wall 8 and a pair of lateral portions folded onto the main portion along a bend line formed at the base of bottom tab 33.

Packaging material 2 from which package 1 is made has a multilayer structure comprising a base layer, e.g. of paper, for stiffness, and a number of lamination layers covering both sides of base layer.

In the example shown, the lamination layers comprise a first layer of oxygen-barrier material, e.g. an aluminum foil, and a number of second layers of heat-seal plastic material covering both sides of both base layer and first layer. In other words, such solution comprises, in succession and from the side eventually forming the inside of package 1, a layer of heat-seal plastic material, a layer of barrier material, another layer of heat-seal plastic material, base layer, and another layer of heat-seal plastic material.

The inner layer of heat-seal plastic material contacting the food product, in use, may, for example, be made of strong, in particular, high-stretch, metallocene-catalyzed, low-linear-density (LLD) polyethylene.

Normally, layers of heat-seal plastic material are laminated on the base layer in a melted state, with successive cooling.

As a possible alternative, at least the inner layers of plastic material may be provided as prefabricated films, which are laminated on the base layer; this technique allows reducing any risk of formation of holes or cracks at or around the removable portion during the forming operations for producing sealed package 1.

Figure 1A:
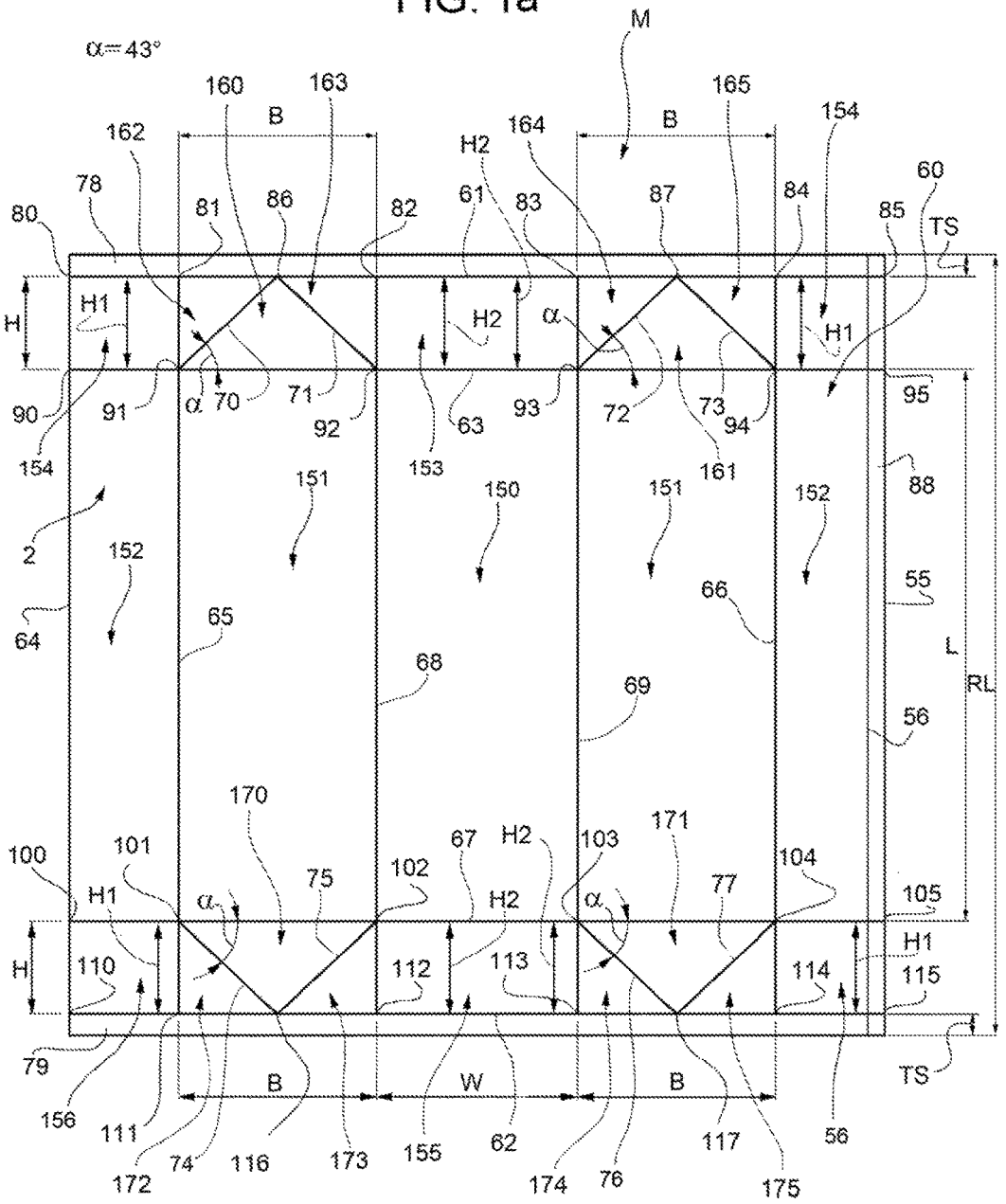
FIGS. 1*a* and 1*b* show a first embodiment of a sheet packaging material according to the present invention.
Figure 1B:
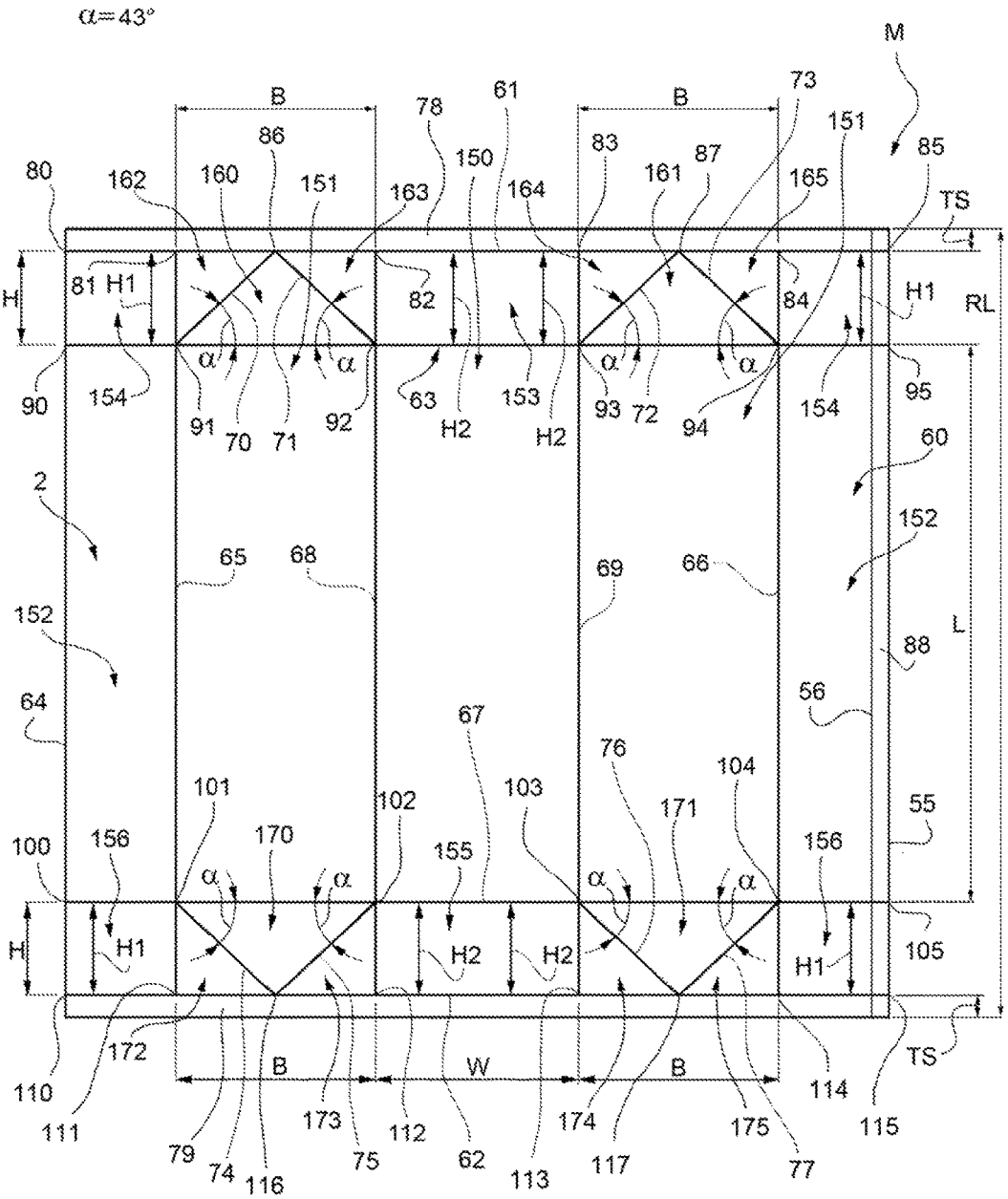
Figure 2:
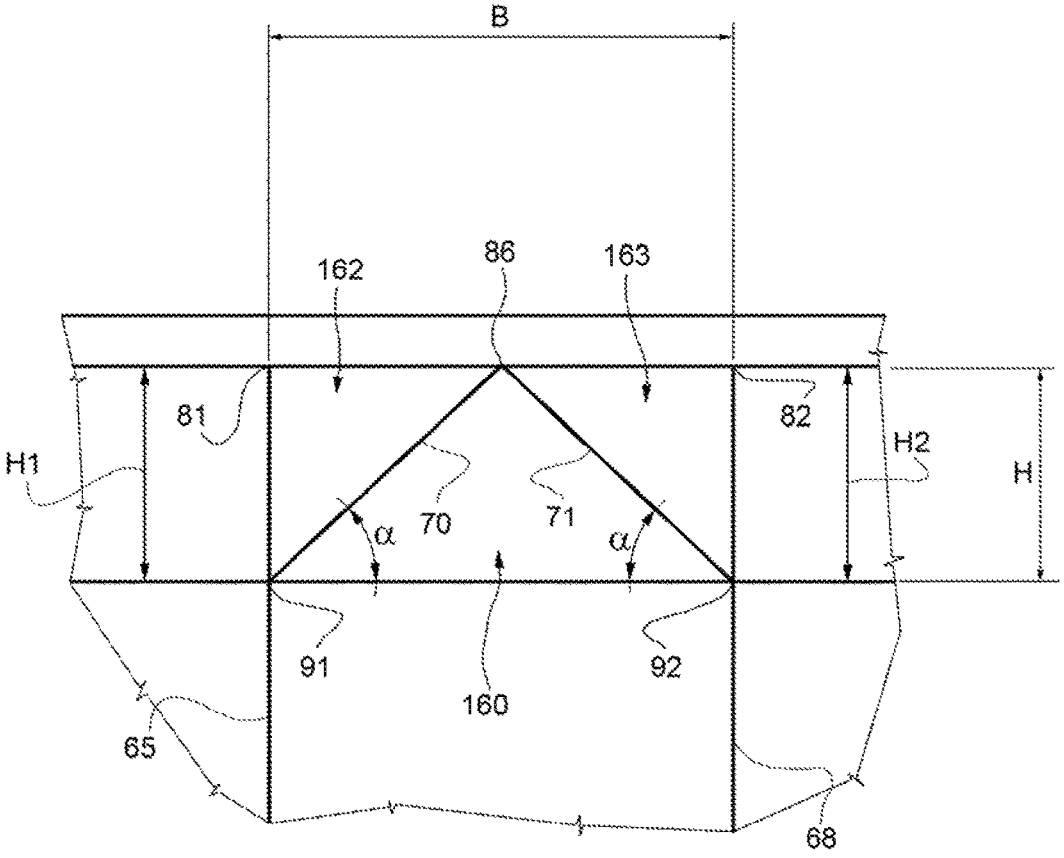
FIG. 2 shows an enlarged portion of the sheet packaging material of FIGS. 1*a* and 1*b;*

Letter M in FIGS. 1*a*, 1*b* indicates a basic unit of packaging material 2, by which to produce package 1, and which may be a precut blank, or a portion of a web of packaging material comprising a succession of units M.

In the first case, basic unit M is folded on a known folding spindle (not shown), is filled with the food product, and is sealed at the top and bottom to form package 1.

In the second case, the web of packaging material 2, comprising a succession of basic units M, is:

- folded into a cylinder to form a vertical tube having constant circumference and longitudinally sealed;
- filled continuously with the food product; and
- sealed transversely and cut into basic units M, which are then folded to form respective packages 1.

Basic unit M has a crease pattern 60, i.e. a number of crease lines defining respective fold lines, along which packaging material 2 is folded to form the finished package 1.

Crease pattern 60 substantially comprises:

- a transversal crease line 63 for forming edges 15, 16, 17 of finished package 1;
- a transversal crease line 67 for forming edges 10, 11, 12 of finished package 1; and
- a pair of transversal crease lines 61, 62 for allowing the folding of top sealing band 21 and of bottom sealing band 25.

Crease lines 63, 67, 61, 62 are parallel to one another.

Crease lines 63, 67 are interposed between crease lines 61, 62.

Crease pattern 60 comprises:

- a pair of longitudinal crease lines 65, 66 parallel to each other;
- a pair of longitudinal crease lines 68, 69 parallel to each other and interposed between crease lines 65, 66;

a pair of longitudinal end edges 64, 55 opposite to one another; and an edge area 88 bounded by edge 55 and an edge 56, and which is intended to be sealed on an opposite edge 64 of basic unit M to form a cylinder.

In detail, crease lines 65, 66, 68, 69 and edges 64, 55 are parallel to each other and orthogonal to crease lines 63, 67, 61, 62.

Still more precisely, crease lines 68, 69 are interposed between crease lines 65, 66.

Crease lines 65, 66 are, in turn, interposed between edges 64, 55.

Crease pattern 60 also comprises:

a rectangular end area 78 which is bounded by crease line 61; and a rectangular end area 79 which is bounded by crease line 62.

End area 78 is adapted to form top tab 29 and end area 79 is adapted to form bottom tab 33 of finished package 1, once basic unit M has been folded and sealed.

Crease line 61 intersects edge 64, creases lines 65, 68, 69, 66 and edge 55 respectively at intersection points 80, 81, 82, 83, 84, 85.

Crease line 63 intersects edge 64, creases lines 65, 68, 69, 66 and edge 55 respectively at intersection points 90, 91, 92, 93, 94, 95.

Crease line 67 intersects edge 64, creases lines 65, 68, 69, 66 and edge 55 respectively at intersection points 100, 101, 102, 103, 104, 105.

Crease line 62 intersect, edge 64, creases lines 65, 68, 69, 66 and edge 55 respectively at intersection points 110, 111, 112, 113, 114, 115.

Creasing pattern 60 comprises (FIG. 1*b*):

a panel 150, which is bounded by points 92, 93, 102, 103 and is adapted to define front wall 8 of the finished package 1, once basic unit M has been folded;

a pair of panels 151 arranged on opposite sides of panel 150, one of which is defined by points 91, 92, 101, 102 and the other one of which is defined by points 93, 94, 103, 104, and adapted to define lateral walls 9 of the finished package 1; and a pair of panels 152 arranged on opposite sides of respective panels 151, a first one of panels 152 is defined by points 90, 91, 100, 101 and the second one of panels 152 is defined by points 94, 95, 104, 105, and adapted to define rear wall 7 of finished package 1, once basic unit M has been folded and edge area 68 has been sealed on edge 64.

Creasing pattern 60 also comprises (FIG. 1*b*):

a rectangular panel 153 defined by points 82, 83, 92, 93, and adapted to define portion 22 of top wall 5;

a pair of rectangular panels 154 arranged laterally with respect to panel 153, defined respectively by points 80, 81, 90, 91 and 84, 85, 94, 95 and adapted to define portion 23 of top wall 5 of finished package 1;

a rectangular panel 155 defined by points 102, 103, 112, 113, and adapted to define first portion of bottom wall 6; and a pair of rectangular panels 156 arranged laterally with respect to panel 155, defined respectively by points 100, 101, 110, 111 and 104, 105, 114 and 115, and adapted to define second portion of bottom wall 6.

Creasing pattern 60 further comprises (FIG. 1*a*):

a pair of crease lines 70, 71 (72, 73), each of which extends between a respective point 91, 92 (93, 94) and a common point 86 (87), which is positioned on crease line 61 and is interposed between points 81, 82 (83, 84); and a pair of crease lines 74, 75 (76, 77), each of which extends between a respective point 101, 102 (103, 104) and a common point 116 (117), which is positioned on crease line 62 and is interposed between points 111, 112 (113, 114).

Crease lines 70, 71, 72, 73, 74, 75, 76, 77 are sloped with respect to crease lines 61, 67, 63, 62, edges 64, 55 and crease lines 65, 68, 69, 66, 60.

Thanks to the presence of crease lines 70, 71, 72, 73, 74, 75, 76, 77, creasing pattern 60 comprises (FIGS. 1*a* and 1*b*):

a pair of top triangular panels 160, 161 defined by points 86, 91, 92 and points 87, 93, 94, respectively;

a triangular panel 162 interposed between panel 160 and panel 154, and defined by points 81, 86, 91;

a triangular panel 163 interposed between panel 160 and panel 153, and defined by points 82, 86, 92:

a triangular panel 164 interposed between panel 161 and panel 153, and defined by points 83, 87, 93; and a triangular panel 165 interposed between panel 161 and panel 154, and defined by points 84, 87, 94.

Once blank M has been folded to form finished package 1, panel 163, panel 162 and panel 160 form one top flap 26 while panel 165, panel 164 and panel 161 form the other top flap 26.

Still more precisely, panel 160 and panel 161 define inner surfaces of respective top flaps 26 superimposed on the upper portion of respective lateral walls 9 while panel 162 and panel 163, and panel 164 and panel 165 define outer surfaces of respective top flaps 26 with respect to lateral walls 9 of finished package 1.

Furthermore, creasing pattern 60 comprises (FIGS. 1*a* and 1*b*):

a pair of bottom triangular panels 170, 171 defined by points 101, 102, 116 and points 103, 104, 117, respectively;

a triangular panel 172 interposed between panel 170 and panel 156, and defined by points 101, 111, 116;

a triangular panel 173 interposed between panel 170 and panel 155, and defined by points 102, 112, 116;

a triangular panel 174 interposed between panel 171 and panel 155, and defined by points 103, 113, 117; and a triangular panel 175 interposed between panel 171 and panel 156, and defined by points 104, 114, 117.

Once blank M has been folded to form finished package 1, panel 173, panel 172 and panel 170 form one bottom flap 32 while panel 175, panel 174 and panel 171 form the other bottom flap 32.

Still more precisely, panel 172 and panel 173, and panel 174 and panel 175 define inner surfaces of respective bottom flaps 32 superimposed on respective bottom wall 6 while panel 170 and panel 171 define outer surfaces of respective bottom flaps 32 with respect to bottom wall 6 of finished package 1.

In the embodiments shown in FIGS. 1 to 5, the distance between point 91 (94) and crease line 61 is indicated as H1.

Similarly, the distance between point 101 (104) from crease line 62 is indicated by H1.

The distance between point 92 (93) from crease line 61 is indicated as H2.

Similarly, the distance between point 102 (103) from crease line 62 is indicated as H2.

In the embodiments shown in FIGS. 1 to 4, the distance H1 equals the distance H2, in other words H1=H2=H, where H is the distance between crease line 63 (67) and crease line 61 (62).

In this case, the distance between crease line 61 and crease line 63 and between crease line 62 and crease line 67, i.e. the height of the panel 160, panel 161; panel 170, panel 171 is equal to distance H and is indicated as height H.

In the embodiments shown in FIGS. 1 to 5, the distance between crease line 65 (66) and crease line 68 (69) is indicated as B.

In the embodiments shown in FIGS. 1 to 4, the distance between points 91, 92; 93, 94; 101, 102 and 103, 104, i.e. the base of panel 160, panel 161, panel 170, panel 171 is equal to distance B and is indicated as base B.

Length of base B corresponds to the length of edges 12 (and of edges 17) of the finished package 1.

In the embodiments shown in FIGS. 1 to 5, the distance between points 92, 93 (102, 103) is indicated as W and corresponds to the width of finished package 1, i.e. to the length of edges 10, 11, 15, 16 of the finished package 1.

In the embodiments shown in FIGS. 1 to 4, the distance between crease line 63 and crease line 67 is indicated as L and correspond to the length of edges 18*a*, 18*b*, 19*a*, 19*b* of the finished package 1, i.e. to the height of finished package 1.

It follows from elementary geometrical considerations that volume V of the finished package 1 equals L*B*W.

Height of areas 78, 79 measured parallel to crease lines 65, 66, i.e. the height of tabs 29, 33, is indicated as TS in FIG. 1*a*.

Length of basic unit M parallel to crease line 65 and crease line 66 is indicated in FIG. 1*a* as RL.

From geometric consideration, it follows that:

$$RL=2*TS+2*H+L.$$

The angles α of panels 160; 161 defined by crease lines 70, 71; 72, 73 and crease line 63 equal to one another.

The angles α of panels 170; 171 defined by crease lines 74, 75; 76, 77 and crease line 67 equal to one another.

In the embodiments shown in FIGS. 1 to 5, the basic units M, M', M", M'" are so configured that $$H1+H2<B$$

The relationship between H2, H2, and B may also be configured such that $$H1+H2+2*S+\Delta=B,$$

where:

S is the thickness of the packaging material 2, 2', 2", 2'", i.e. the thickness of blank M, M', M", M'";

Δ is a factor that takes into account the elasticity of the packaging material 2, 2', 2", 2'".

In addition, in the embodiments shown in FIGS. 1 to 5, distance H1, distance H2 and distance B are measured in millimeters and the basic units M, M', M", M'" are so configured that 2*S+Δ>1 millimeter.

In particular, distance H1, distance H2 and distance B satisfy the following relationship:

$$H1+H2\leq B/1{,}015.$$

Furthermore, distance H1, distance H2 and distance B may satisfy the following relationship:

$$H1+H2\geq B/1{,}07.$$

In the embodiments shown, in FIGS. 1 to 4, H1=H2=H, where H is the distance between crease line 63 (67) and 61 (62).

In this case $$H<B/2$$

This means that angles α are less than 45 degrees.

Preferably, height H and base B satisfy the following relationship: H≤B/2.03.

Still more preferably, height H and base B satisfy the following relationship: H≤B/2.07.

Furthermore, height H and base B satisfy the following relationship: H≥B/2.30.

Preferably, height H and base B satisfy the following relationship: H≥B/2.14.

As a result of the above-identified values of height H and base B, angles α are smaller than 45 degrees.

In the embodiment shown in FIG. 1, angles α are equal to 43 degrees.

In this embodiment, angles α are calculated, taking into account that the segments between points 81, 91 and 82, 92 (83, 93 and 84, 94; 101, 111 and 102, 112; 103, 113 and 104, 114) both of height H are both superimposed to the corresponding segment of length B between points 91, 32 (93, 94; 101, 102; 103, 113; 104; 114), once top flaps 26 and bottom flaps 32 have been folded.

Still more precisely angles α are chosen such that:

$$\tan(\alpha)=(2*H/B)=(B-\Delta-2*S)/B=2*H/(2*H+2*S+\Delta).$$

In other words, the angles α can be chosen on the basis of the thickness S of the packaging material 2, 2' and/or taking into account the elasticity of the packaging material 2, 2'.

On the contrary, in the known solution discussed in the introductory part of the present description, both S and Δ were neglected, thus leading to a blank in which H=B/2 and in which angles α were therefore of 45 degrees.

It is important to point out that distances or lengths B, H, S, Δ, RL, TS, L, W are in the present description considered as nominal distances or lengths, i.e. distances which are not affected by the inevitable manufacturing tolerances.

From the relationship $$\tan(\alpha)=(2*H/B)$$

that was introduced before, it follows:

$$\alpha=\arctan(2*H/B),$$

If numerical values of the ratio 2*H/B are introduced in the latter relationship, corresponding values of the angle α can be calculated.

In particular, when H≤B/2.03, then α≤44.5°.

If H≤B/2.07 then α≤44°.

If H≥B/2.30 then α≥41°.

Finally, when H≥B/2.14 then α≥43°.

Figure 3:
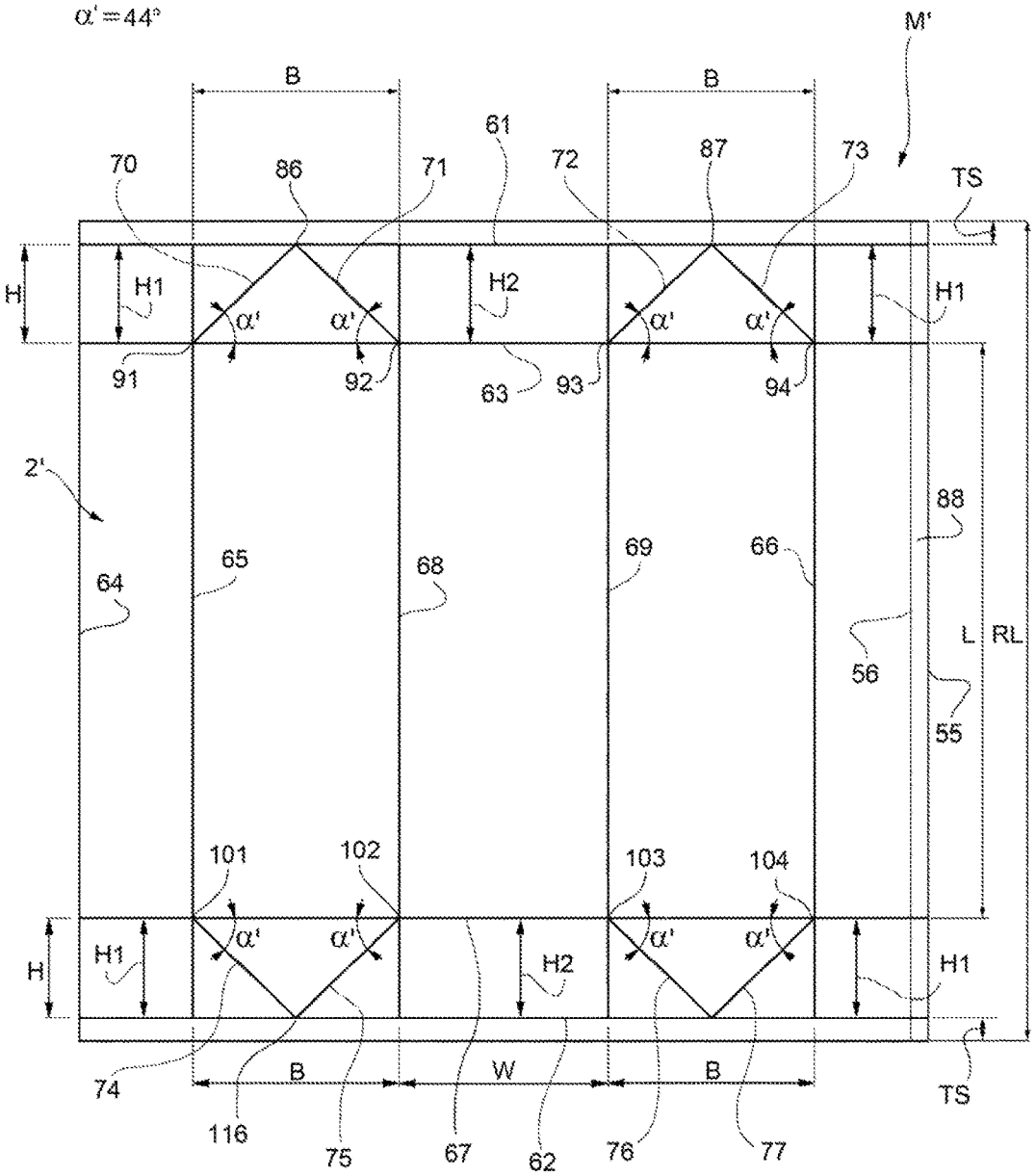
FIG. 3 shows a second embodiment of the sheet packaging material according to the present invention.

Letter M' in FIG. 3 indicates a second embodiment of a basic unit of packaging material 2', by which to produce package 1; basic units M, M' of packaging material 2, 2' are similar to each other, the following description is limited to the differences between them, and using the same references, where possible, for identical or corresponding parts.

Basic unit M' differs from basic unit M in that the amplitude of angles α is 44 degrees.

Figure 4:
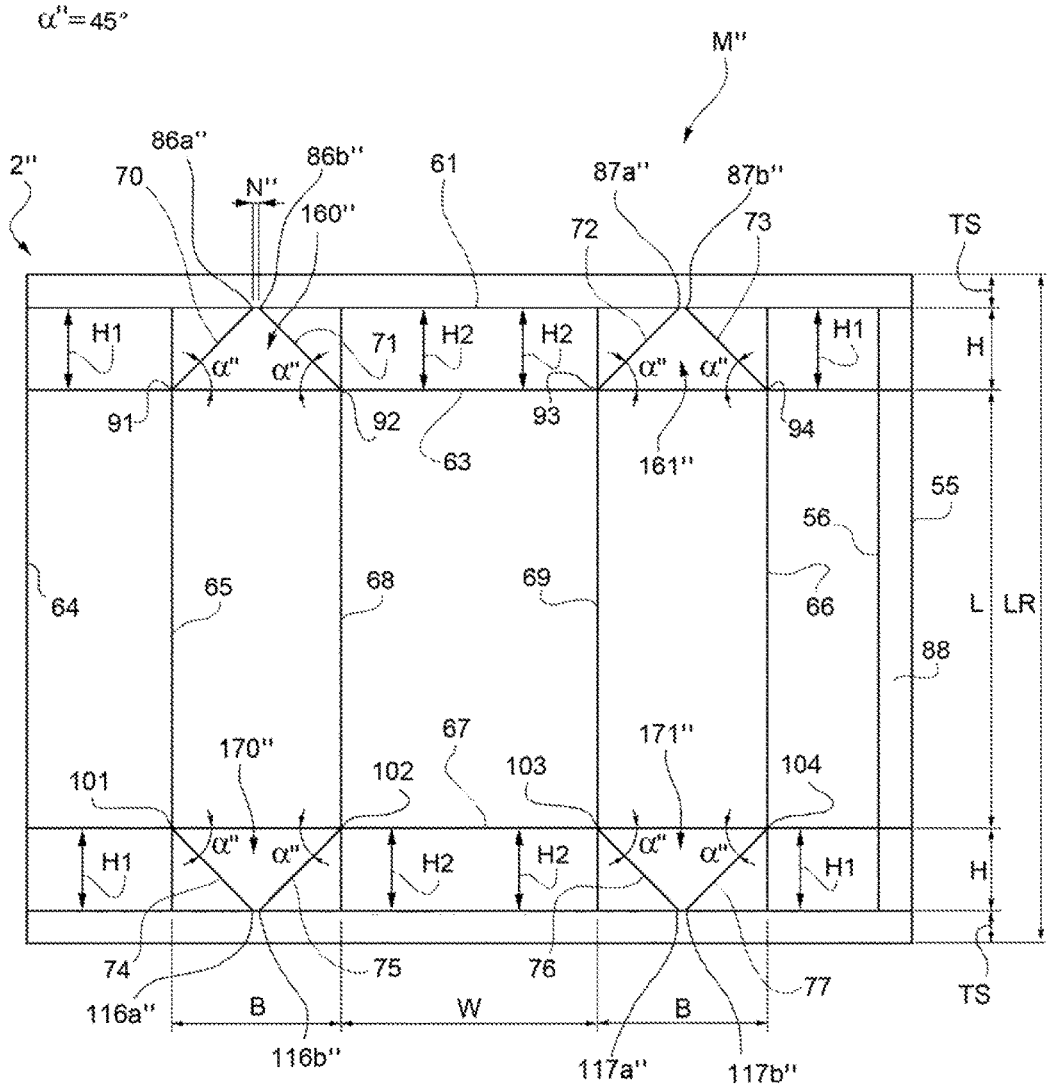
FIG. 4 shows a third embodiment of the sheet packaging material according to the present invention.

Letter M' in FIG. 4 indicates a third embodiment of a basic unit of packaging material 2", by which to produce package 1; basic units M, M" of packaging material 2, 2" are similar to each other, the following description is limited to the differences between them, and using the same references, where possible, for identical or corresponding parts.

Basic unit M" differs from basic unit M in that crease lines 70, 71; 72, 73 (74, 75; 76, 77) intersect crease line 61 (62) in two respective distinct paints 86*a*", 86*b*"; 87*a*", 87*b*" (116*a*", 116*b*"; 117*a*", 117*b*".

As a result, panels 160", 161", 170", 171" are shaped like isosceles trapezoid.

Once basic unit M" has been folded to form a finished package, distance N" between points 86*a*", 86*b*" (87*a*", 87*b*"; 116*a*", 116*b*"; 117*a*", 117*b*") along crease lines 61, 67 is recovered by the thickness of packaging material 2" and/or the elasticity under load of packaging material 2".

Furthermore, the amplitude of angles α" of panels 160", 161", 170", 171" is, in the embodiment shown, 45 degrees.

Letter M"' in FIG. 5 indicates a fourth embodiment of a basic unit of packaging material 2"', by which to produce package 1; basic units M, M"' of packaging material 2, 2"' are similar to each other, the following description is limited to the differences between them, and using the same references, where possible, for identical or corresponding parts.

Basic unit M"' differs from basic unit M in that crease line 63 is not a straight crease line, therefore—in this case—the distance of point 91 (94) from creasing line 61, i.e. distance H1, is different from the distance of point 92 (93) from creasing line 61, i.e. distance H2.

In particular, crease line 63 comprises a first portion 181 extending between point 91 and point 92 and bounding panel 160.

Crease line 63 further comprises a second portion 182 extending between point 93 and point 94 and bounding panel 161.

Crease line 63 further comprises a third portion 183 extending between point 92 and point 93 and bounding panel 150.

Crease line 63 further comprises a fourth portion 184 extending between point 90 and point 91 and bounding one of panels 152.

Crease line 63 further comprises a fifth portion 185 extending between point 94 and point 95 and bounding the other one of panels 152.

First portion 181 is interposed between third portion 183 and fourth portion 184.

Second portion 182 is interposed between third portion 183 and fifth portion 185.

Third portion 183, fourth portion 184 and fifth portion 185 are parallel to each other and parallel to crease line 61.

First portion 181 and second portion 182 are sloped with respect to third portion 183, fourth, portion 184 and fifth portion 185. In addition, first portion 181 and second portion 182 are sloped with respect to crease line 61, crease line 65, crease line 68, crease line 69 and crease line 66.

The distance between fourth portion 184 and crease line 67 is indicated as L1.

The distance between fifth portion 185 and crease line 67 equals the distance between fourth portion 184 and crease line 67 and is also indicated as L1.

The distance between third portion 183 and crease line 67 is indicated, as L2.

Distance L2 is less than distance L1.

In this embodiment, angle β defined by crease line 70 (72) and crease line 71 (73) is greater than 90 degrees. This dimension differs from the known solutions where β is equal to 90 degrees.

Preferably, the following relationship is valid: β≤90.9°.

Still more preferably, angle β satisfies the following relationship: β≥92°.

Furthermore, angle β defined by crease line 70 (72) and crease line 71 (73) is smaller than, or equal to, 98°.

Preferably, the following relationship is valid: β≤93.9°.

The advantages of sheet packaging material 2, 2', 2", 2"' and respective blanks M, M', M", M"' according to the present invention will be clear from the above description.

In particular, height H between crease lines 61, 67 (62, 63) is less than a half of base B between points 91, 92 (93, 94; 101, 102; 103, 104).

In other words, height H of panels 160, 161, 171, 172 is less than a half of base B of panels 160, 161, 171, 172.

Figure 8:
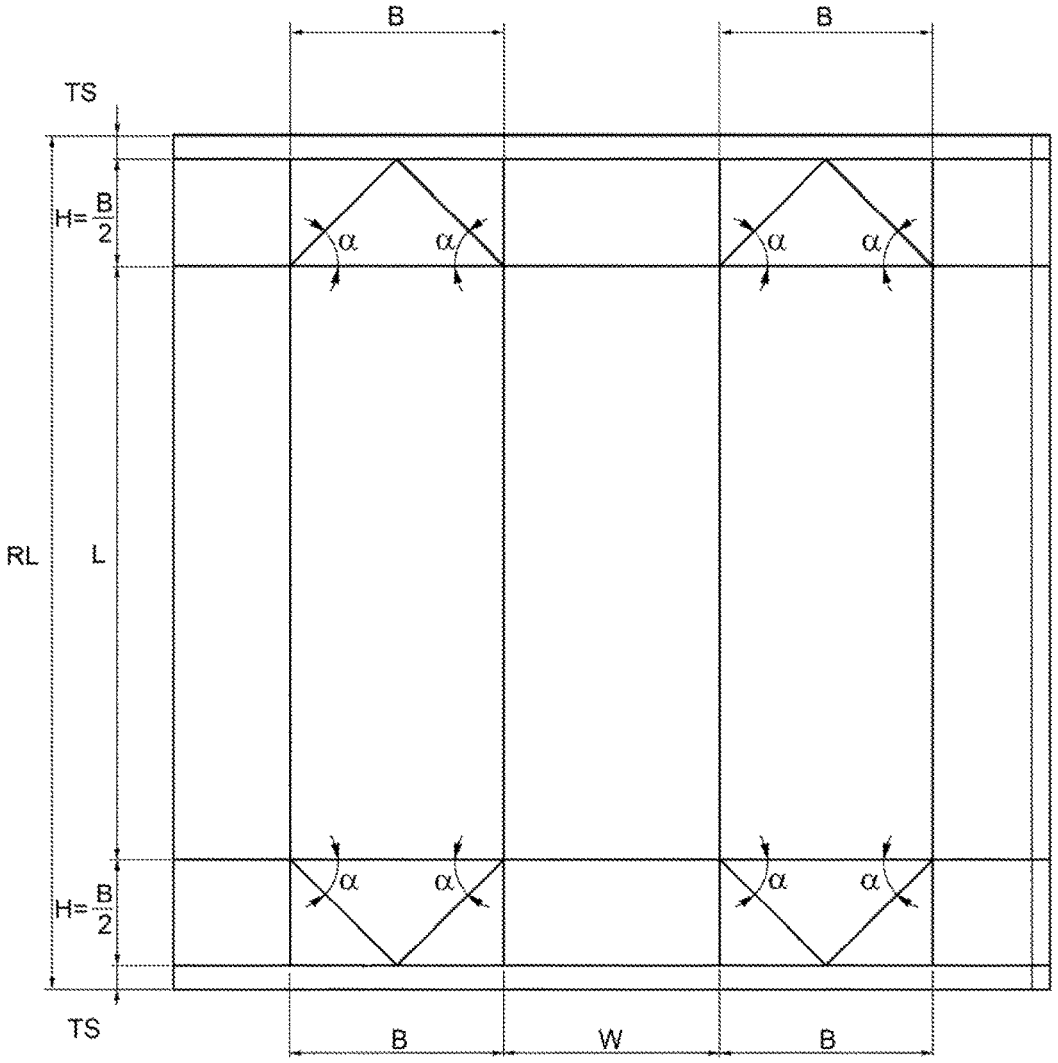
FIG. 8 PRIOR ART
FIG. 8 shows a prior art solution of sheet packaging material.

As a result, for a given value of base B and therefore for a given size of package 1, on one hand, length RL=2TS+2*H+L of basic unit M, M', M" is reduced with respect to the prior art solution shown in FIG. 8 and in which H=B/2.

On the other hand, volume V of package 1 remains constant, since volume V equals L*B*W and is, therefore, not affected by the value of height H.

Accordingly, it is possible to produce package 1 of a given volume, with a reduced amount of packaging material 2, 2', 2".

In the very same way, it is also possible to use the same amount of packaging material 2, 2', 2" for forming a package 1 of increased volume V.

Furthermore, the Applicant has found that, due to the fact that height H is less than a half of base B, walls 9 of finished package 1 are in compression while walls 5, 6 of finished package 1 are in traction.

As a result, the final shape of package 1 is better and easier to be formed than packages formed by a known basic unit of the kind shown in FIG. 7.

The Applicant has also found that the condition H>B/2.30 ensures that the curvature of edges 12 of finished package 1 does not determine a not acceptable shaping of finished package 1.

This is still more true in case H>B/2.14.

In other words, the condition H>B/2.30, preferably H>B/2.14, ensures a correct forming of edges 12 of finished package 1.

The Applicant has also found that the condition H<B/2.03, preferably H<B/2.07, ensures that the inevitable tolerances of the blanks M, M', M" do not affect the final forming of finished package 1.

Still more precisely, the condition B/2.30<H<B/2.03 is a good compromise to ensure a correct forming of finished package 1 and a relevant saving of the amount of packaging material 2, 2', 2" needed to form that package 1.

In case segments between points 81, 91 and 82, 92 (83, 93 and 84, 94; 101, 111 and 102, 112; 103, 113 and 104, 114) are both of length H, angles α, α' are calculated, in such a way that such that:

$$2*H+2*S+\Delta=B,$$

where:

S is the thickness of the packaging material 2, 2', 2", i.e., the thickness of blank M, M', M";

Δ is a factor that takes into account the elasticity of the packaging material 2, 2', 2".

In case (shown in FIG. 5) height H1 of segment between points 81, 91 (84, 94) is different from height H2 of segment between points 82, 92 (83, 93):

$$H1+H2+2*S+\Delta=B.$$

In other words, the value of H1 and H2 are optimized for any value of thickness S of packaging material 2, 2', 2", 2"' and/or of elasticity of the latter.

It is therefore possible to take advantage of the thickness and the elasticity of the packaging material 2, 2', 2", 2'" to compensate the savings in the length of blank M, M', M", M'".

In case of blank M", panels 160', 161', 162', 163' are trapezoidal and distance N" between points 86*a*", 86*b*" (87*a*", 87*b*"; 116*a*", 116*b*"; 117*a*", 117*b*") is recovered thanks to thickness S of blank M".

Clearly, changes may be made to sheet packaging material 2, 2', 2", 2'" as described and illustrated herein without, however, departing from the scope defined in the accompanying claims.

In particular, blank M, M', M", M'" could not comprise either panels 162, 160, 163; 164, 161, 165 or panels 172, 170, 173; 174, 171, 175 and the resulting package 1 could therefore not comprise either top flaps 26 or bottom flaps 32.

Furthermore, the distance between crease line 61 and crease line 67 could be different from the distance between crease line 62 and crease line 63.

The length of base B between points 91, 92 could be different from the length of the base between points 93, 94 (or 101, 102 or 103, 104).

Finally, finished package 1 could comprise one or more further walls interposed between wall 9 and wall 7 or wall 8.

The invention claimed is:

1. A sheet packaging material for producing a sealed package of a pourable food product, comprising:

at least one first crease line and at least one second crease line;

at least one third crease line which intersects said first crease line in at least one first point and said second crease line in at least one second point;

at least one fourth crease line transverse to said first crease line and to said second crease line;

at least one first panel bounded, at least in part, by said first crease line, said second crease line and said third crease line; said first panel being adapted to define a lateral wall of said finished package once said sheet packaging material has been folded;

at least one fifth crease line, which extends between said first point and said fourth crease line;

at least one sixth crease line, which extends between said second point and said fourth crease line; and at least one second panel bounded by said fifth crease line, said sixth crease line and a portion of said third crease line interposed between said first point and said second point; said second panel being adapted to define at least part of a first folded flap of said finished package once said sheet packaging material has been folded;

said first point and said fourth crease line being spaced by a first distance;

said second point and said fourth crease line being spaced by a second distance;

said first crease line and said second crease line being spaced by a third distance;

$$H1+H2<B$$

where:

H1 is said first distance, H2 is said second distance and B is said third distance.

2. The sheet packaging material of claim 1, wherein H1+H2+2*S+Δ=B, where:

S is the thickness of said packaging material; and

Δ is a factor that takes into account the elasticity of said packaging material.

3. The sheet packaging material of claim 2, wherein said first distance (H1) said second distance (H2) and said third distance (B) are measured in millimeters and 2*S+Δ>1 millimeter.

4. The sheet packaging material of claim 1, wherein H1+H2≤B/1.015.

5. The sheet packaging material of claim 1, wherein H1+H2≥B/1.07.

6. The sheet packaging material of claim 1, wherein H1=H2=H where H is the distance between said third crease line and said fourth crease line.

7. The sheet packaging material of claim 6, wherein H≤B/2.03.

8. The sheet packaging material of claim 6, wherein H≤B/2.07.

9. The sheet packaging material of claim 6, wherein H≥B/2.30.

10. The sheet packaging material of claim 6, wherein H≥B/2.14.

11. The sheet packaging material of claim 6, wherein said second panel is triangular, said fifth crease line and said third crease line defining therebetween at least one first angle.

12. The sheet packaging material of claim 11, wherein the amplitude of said first angle is smaller than 45 degrees.

13. The sheet packaging material of claim 11, wherein the amplitude of said first angle is substantially 44 degrees.

14. The sheet packaging material of claim 11, wherein the amplitude of said first angle is substantially 43 degrees.

15. The sheet packaging material of claim 11, wherein the amplitude of said first angle is smaller than, or equal to, 44.5 degrees.

16. The sheet packaging material of claim 11, wherein the amplitude of said first angle is smaller than 44 degrees.

17. The sheet packaging material of claim 11, wherein the amplitude of said first angle is greater than, or equal to, 41 degrees.

18. The sheet packaging material of claim 11, wherein the amplitude of said first angle is greater than 43 degrees.

19. The sheet packaging material of claim 6, wherein said second panel is trapezoidal.

20. The sheet packaging material of claim 19, wherein said fifth crease line and said third crease line define therebetween at least one first angle of 45 degrees of amplitude.

21. The sheet packaging material of claim 19, wherein said fifth crease line extends between said first point and a third point of said fourth crease line;

said sixth crease line extending between said second point and a fourth point of said fourth crease line, distinct from said third point;

said third point and said fourth point being spaced along said fourth crease line.

22. The sheet packaging material of claim 1, wherein H1≠H2, and wherein said fifth crease line and said sixth crease line define therebetween at least one angle having an amplitude that is greater than 90°.

23. The sheet packaging material of claim 22, wherein said at least one angle has an amplitude that is greater than, or equal to, 90.9°.

24. The sheet packaging material of claim 22, wherein said at least one angle has an amplitude that is greater than, or equal to, 92°.

25. The sheet packaging material of claim 22, wherein said at least one angle has an amplitude that is less than, or equal to, 98°.

26. The sheet packaging material of claim 22, wherein said at least one angle has an amplitude that is less than, or equal to, 93.9°.

27. The sheet packaging material of claim 1, comprising a pair of second panels arranged on respective opposite sides of said first panel and adapted to define a first flap and a second flap of said finished package opposite to each other once said sheet packaging material has been folded.

28. The sheet packaging material of claim 1, comprising:

a further first crease line and a further second crease line;

a further first point defined by the intersection of said further first crease line with said third crease line;

a further second point defined by the intersection of said further second crease line with said third crease line;

a further fifth crease line, which extends between said further first point and said fourth crease line;

a further sixth crease line, which extends between said further second point and said fourth crease line; and at least one further second panel bounded by said further fifth crease line, said further sixth crease line and a portion of said third crease line interposed between said further first point and said a further second point;

said further second panel being adapted to define at least part of a further first flap of said finished package once said sheet packaging material has been folded.

29. A sealed package for pourable food products obtained by folding a sheet packaging material according to claim 1 and comprising:

a bottom wall;

a top wall;

at least one lateral wall interposed between said bottom wall and said top wall and defined by said first panel;

at least one top first flap protruding from said top wall and folded on at least part of said lateral wall; and/or at least one bottom second flap folded on said bottom wall as of said lateral wall;

said at least one top first flap and/or said at least one bottom second flap being defined by said at least one second panel.

30. A sheet packaging material for producing a sealed package of a pourable food product, comprising:

at least one first crease line and at least one second crease line;

at least one third crease line which intersects said first crease line in at least one first point and said second crease line in at least one second point;

at least one fourth crease line transverse to said first crease line and to said second crease line;

at least one fifth crease line, which extends between said first point and said fourth crease line;

at least one sixth crease line, which extends between said second point and said fourth crease line; and at least one panel bounded by said fifth crease line, said sixth crease line and a portion of said third crease line interposed between said first point and said second point; said panel being adapted to define at least part of a first folded flap of said finished package once said sheet packaging material has been folded;

said first point and said fourth crease line being spaced by a first distance;

said second point and said fourth crease line being spaced by a second distance;

said first point and said second point being spaced by a further distance;

the sum of said first distance and said second distance is less than said further distance.

31. The sheet packaging material of claim 30, further comprising at least one first panel bounded, at least in part, by said first crease line, said second crease line and said third crease line; said first panel being adapted to define a lateral wall of said finished package once said sheet packaging material has been folded.

32. The sheet packaging material of claim 30, wherein said first distance is equal to said second distance.

33. The sheet packaging material of claim 32, wherein said panel is triangular, said fifth crease line and said third crease line defining therebetween at least one first angle.

34. The sheet packaging material of claim 33, wherein the amplitude of said first angle is smaller than 45 degrees.

35. The sheet packaging material of claim 33, wherein the amplitude of said first angle is smaller than, or equal to, 44.5 degrees.

36. The sheet packaging material of claim 33, wherein the amplitude of said first angle is smaller than, or equal to, 44 degrees.

37. The sheet packaging material of claim 33, wherein the amplitude of said first angle is greater than, or equal to, 41 degrees.

38. The sheet packaging material of claim 33, wherein the amplitude of said first angle is greater than, or equal to, 43 degrees.

39. The sheet packaging material of claim 30, wherein said first distance is different from said second distance and wherein said fifth crease line and said sixth crease line define therebetween at least one angle having an amplitude that is greater than 90°.

40. The sheet packaging material of claim 39, wherein said at least one angle has an amplitude that is greater than, or equal to, 90.9°.

41. The sheet packaging material of claim 39, wherein said at least one angle has an amplitude that is greater than, or equal to, 92°.

42. The sheet packaging material of claim 39, wherein said at least one angle has an amplitude that is less than, or equal to, 98°.

43. The sheet packaging material of claim 39, wherein said at least one angle has an amplitude that is less than, or equal to, 93.9°.

* * * * *